US005212933A

United States Patent [19]

Cere'

[11] Patent Number: 5,212,933

[45] Date of Patent: May 25, 1993

[54] APPARATUS FOR WRAPPING PALLETIZED COMMODITIES IN PLASTIC FILM

[75] Inventor: Mauro Cere', Loiano, Italy

[73] Assignee: Robopac Sistemi S.r.l., Forli, Italy

[21] Appl. No.: 881,535

[22] Filed: May 12, 1992

[30] Foreign Application Priority Data

Mar. 9, 1992 [EP] European Pat. Off. ..... 92830107.6

[51] Int. Cl.[5] ..... B65B 11/04

[52] U.S. Cl. ..... 53/556; 53/587; 53/588

[58] Field of Search ..... 53/556, 587, 588, 210, 53/211, 441, 399

[56] References Cited

U.S. PATENT DOCUMENTS

| | | | |
|---|---|---|---|
| 2,074,892 | 3/1937 | Derry | 53/588 X |
| 4,216,640 | 8/1980 | Kaufman | 53/556 |
| 4,887,719 | 12/1989 | Kapke | 53/556 X |
| 5,003,752 | 4/1991 | Matsumoto | 53/587 X |

FOREIGN PATENT DOCUMENTS

| | | | |
|---|---|---|---|
| 205909 | 12/1986 | European Pat. Off. | 53/587 |
| 0279871 | 8/1988 | European Pat. Off. . | |
| 2303590 | 8/1973 | Fed. Rep. of Germany | 53/210 |
| 3615450 | 11/1987 | Fed. Rep. of Germany | 53/556 |
| 15791 | 2/1977 | Japan | 53/556 |
| WO86/01783 | 3/1986 | PCT Int'l Appl. . | |
| WO8909727 | 10/1989 | World Int. Prop. O. | 53/556 |

OTHER PUBLICATIONS

"Super Spider", Infrapak Corp. PMMI show Oct. 1980.

*Primary Examiner*—John Sipos

*Attorney, Agent, or Firm*—Fay, Sharpe, Beall, Fagan, Minnich & McKee

[57] ABSTRACT

A pallet base stacked with commodities for wrapping is positioned on a horizontal platform, whereupon the wrapping operation is effected by an L-profile beam carrying a roll of plastic film and rotatable about a vertical axis in such a way as to circle the platform and wind the film around the pallet; to advantage, the horizontal member of the beam lies below the uncoiling roll of film, passing between the platform and a horizontal bed afforded by the stationary frame of the apparatus, such that with the L-beam set in rotation about the main axis a low center of inertia is achieved.

14 Claims, 3 Drawing Sheets 1
1a
11a
11
13
31
15
14
21
20
37
16
16a
18
14
15
19
24
6
18
7
8
V
40
41
42
9
43
23
3
34
33
32
30
4
2
36
19
22
35
5
F3
X
10
17
16b
12
P 24
S2
6
F1
S1
S2
17
19
18
16b
16
22
F
S1
14
37
11a
14
13
11
16
31
S1
16a
S1
15
S1

APPARATUS FOR WRAPPING PALLETIZED COMMODITIES IN PLASTIC FILM

BACKGROUND OF THE INVENTION

The present invention relates to an apparatus for wrapping palletized stacks of commodities in a plastic film material.

There are currently numerous machines of the type in question available for purchase (typically as disclosed in Italian patent 1 179 310), consisting generally in a load-bearing frame of gantry type construction, and a beam of upturned 'L' profile suspended rotatably from the center of the frame by the horizontal member of the 'L' and set in motion by a drive system. The vertical member of the 'L' carries a station serving to support a roll of the plastic wrapping film; as a rule this same station is also capable of a controlled traversing movement on the vertical member of the beam, such that the stacked commodities can be enveloped to their full height.

The palletized stacks of commodities for wrapping are positioned at the center of the apparatus, or rather the center of the gantry, either by a pallet lift truck (in the case of more simple equipment), or by means of a permanently installed horizontal conveyor running at floor level directly beneath the gantry; once the pallet is at a standstill in the required position, a restraint device will be activated in such a way as to descend and stabilize the entire pallet load by engaging the top face of the stack of commodities. Thereupon, the free end of the film is secured to the pallet base or held fast by means of a gripper mechanism, and the drive system is activated: the upturned 'L' beam begins circling the pallet, and the stacked commodities are enveloped gradually by the uncoiling film. Where the width of the film is less than the height of the stacked commodities (as will normally be the case), the roll of film naturally must be made to ascend and descend on the vertical member of the beam to ensure that the commodities are enveloped completely from top to bottom. In most instances the plastic film is stretched during the wrapping operation (by applying a braking action to the roll) to the ends of achieving a certain saving on the cost of the wrapping material utilized, and of increasing the tension of the wrapping in order to enhance its ultimate tightness around the pallet, especially where the commodities are stacked high. The main drawbacks besetting such apparatus derive for the most part from the significant bulkiness of the gantry frame, which has to carry the 'L' beam and its drive system, together with the relative transmission components. As a direct consequence, the entire apparatus is rendered especially heavy, not least by reason of the fact that the center of the masses in rotation lies high up in the frame, demanding suitably proportioned reaction elements to offset the forces generated in operation. A further drawback, stemming from the first, is the need to maintain a low wrapping speed precisely in order to limit the mechanical stresses generated in rotation.

Accordingly, the object of the present invention is to overcome the drawbacks briefly outlined above, by providing an apparatus for wrapping palletized stacks of commodities such as will ensure a swift, precise wrapping action and faster operation per unit of mass, while featuring compact dimensions and advantages of economy.

SUMMARY OF THE INVENTION

The stated object is realized in an apparatus for wrapping pallets according to the invention, which is of the type comprising a frame, and supported by the frame, a beam of 'L' profile anchored rotatably to the frame and set in motion by a drive system, of which the vertical member supports a roll of wrapping material rotatable about its own vertical axis and invested with controlled axial movement by a relative drive in such a way as to ascend and descend on the vertical member; also a horizontal platform on which to stand the pallet, and gripping means, positioned adjacent to the roll, by which the material is secured to the pallet at its free end before the start of the wrapping operation and cut through on completion of the operation. Advantageously, in the apparatus disclosed, the 'L' profile beam is disposed with the horizontal member positioned beneath the roll of wrapping material, extending between the base of the frame and the platform which supports the pallet, and is anchored in rotation at a point low down in the apparatus, coinciding with the axis of rotation of the beam.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
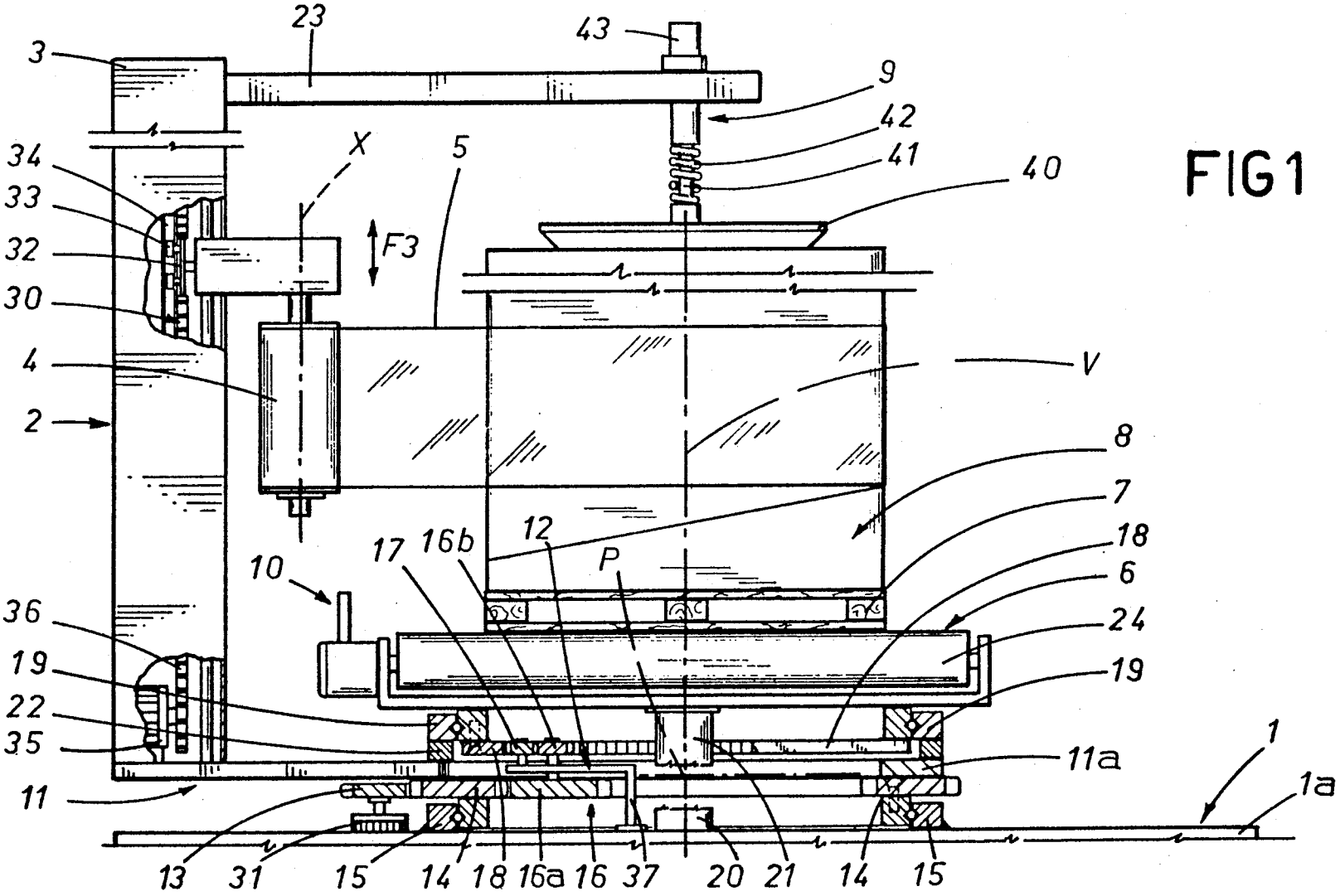
FIG. 1 shows the wrapping apparatus according to the invention in a side elevation, with certain parts cut away better to reveal others, and certain shown in section.

With reference to the accompanying drawings, a wrapping apparatus according to the invention (see FIG. 1 in particular) comprises a frame, denoted 1, and a beam 2 of 'L' profile consisting essentially in a vertical member 3 and a horizontal member 11, mounted rotatably to the frame 1 and set in motion by drive means, for example a geared motor 31; the vertical member 3 of the beam serves to support a roll 4 of stretch plastic film 5, which is able to rotate about its own vertical axis (denoted X) and capable also of controlled sliding movement, in a vertical direction, produced by means 30 consisting in a carriage bracket 32 disposed transversely in relation to the vertical member 3 and furnished with wheels 33 running on a vertical track 34; the carriage 32 is set in motion by a drive unit 35 positioned at the base of the vertical member 3, and a chain 36 connected to the carriage itself. The frame 1 also supports a horizontal platform 6 on which to stand the pallet 7 with its stack of commodities 8; in the embodiment illustrated by way of example, the platform coincides with a roller table 24 carrying gripping means 10 on the side nearer to the roll 4, by which the film 5 is made fast at its free end to the commodities 8 as the wrapping operation commences, and cut through once the operation has been completed.

Figure 2:
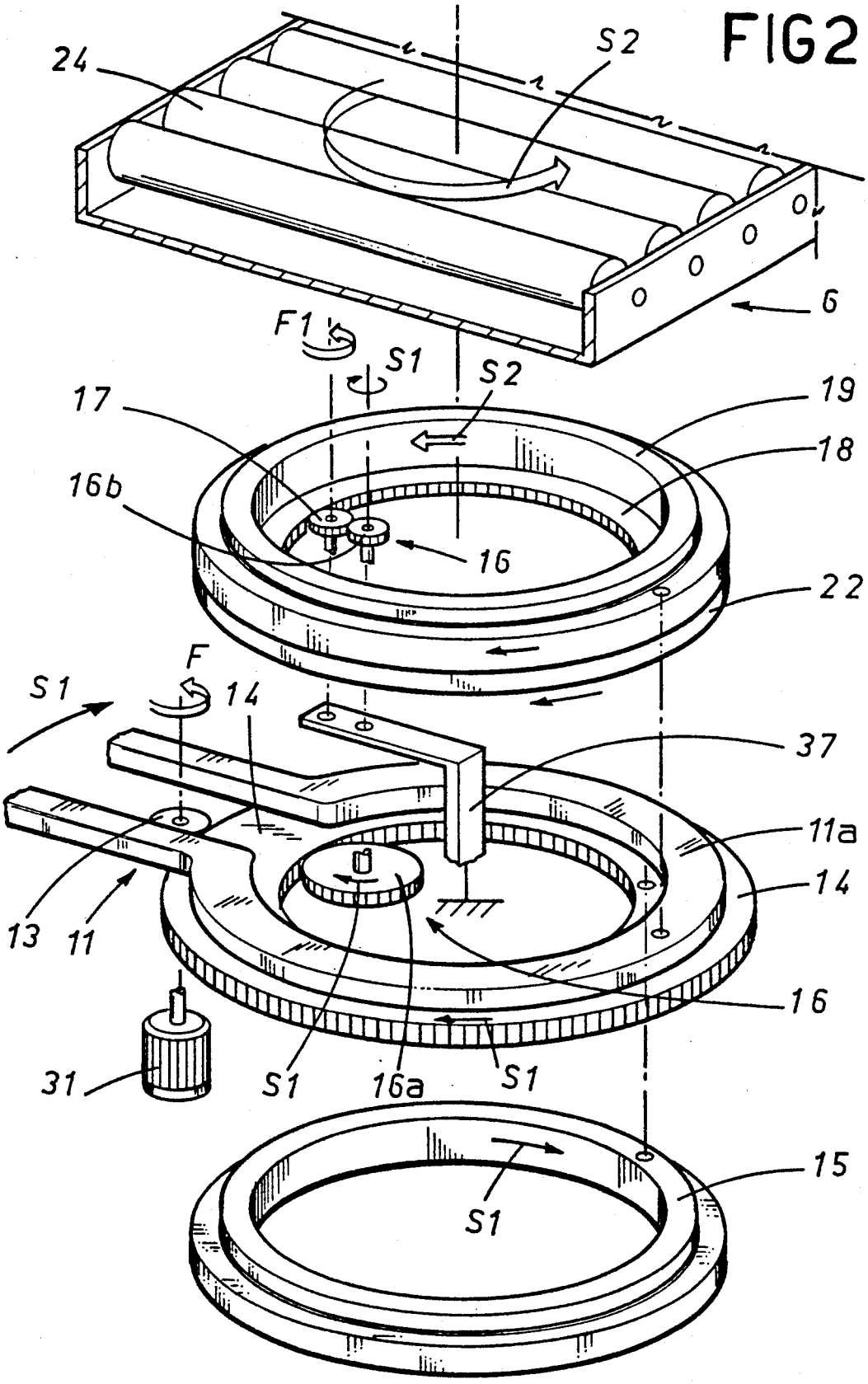
FIG. 2 is an exploded illustration of the drive transmission arrangement utilized in the apparatus according to the invention.

Advantageously, the horizontal member 11 of the 'L' beam 2 is positioned beneath the roll 4, extending between a horizontal bed 1*a* afforded by the frame 1 and the platform 6 which supports the pallet 7, and virtually anchored pivotably at a point P coinciding low down in the apparatus with a vertical axis V about which the beam 2 is caused to rotate in a first direction denoted S1 in FIG. 2. Likewise in FIG. 2, it will be seen that the endmost portion 11*a* of the horizontal member 11 lying remote from the vertical member and beneath the platform 6 is substantially annular in embodiment.

12 denotes means associated with and serving to set the platform 6 in rotation about the aforementioned axis V, in a direction S2 (FIG. 2) opposite to the first direction S1. The means 12 in question are to all intents and purposes drive transmission means, interposed between the frame 1 and the platform 6, by which both the horizontal member 11 and the platform itself are invested with motion in such a manner as to allow of rotating the beam 2 in the first direction S1 and at the same time rotating the platform 6, or at least the part of the roller table 24 occupied by the pallet 7, in the opposite direction S2 (the two directions of rotation are clearly discernible from FIGS. 2 and 3).

More exactly, such drive transmission means 12 (see FIGS. 2 and 3 in particular) include a first driving gear wheel 13 keyed coaxially to the shaft of the aforementioned geared motor 31, which is mounted to the frame 1; this first gear wheel 13 meshes with an internally and externally toothed first ring gear 14 rigidly associated with a first bearing 15 located between the annular end portion 11*a* of the horizontal member 11 and the frame 1, such that the horizontal member 11 is able to rotate in the first direction S1.

The internal teeth of the first ring gear 14 mesh in turn with the bottom gear wheel 16*a* of a double idler 16, freely rotatable and supported from the frame 1 by means of a bracket 37, of which the top gear wheel 16*b* meshes in a plane above the plane of rotation of the horizontal member 11 with a second idle gear 17, also freely rotatable and supported by the bracket 37. The second idle gear 17 meshes in turn with a second ring gear 18 similar to the first but with internal teeth only and associated rigidly with a second bearing 19, located between the platform 6 and the horizontal member 11, which allows the platform 6 to rotate in the direction S2 opposite to that of the horizontal member 11. 20 and 21 denote rotary type power contactors or couplings (indicated schematically in FIG. 1, being conventional in embodiment) associated centrally with the first and the second bearing 15 and 19, respectively, and brought into dynamic operation during rotation of the horizontal member 11 and of the platform 6. The second bearing 19 is seated on a ring 22 which serves also to distance the bearing from the horizontal member 11.

9 denotes a restraint mechanism associated with the 'L' profile beam 2 and positioned above the pallet, of which the purpose is to immobilize the stack of commodities 8 in relation to the platform 6 for the duration of the wrapping operation; more exactly, the restraint mechanism 9 is carried by a second horizontal member 23 disposed transversely to and extending from the top end of the vertical member 2 of the beam, and consists in a plate 40 associated with a central rod 41 accommodated axially and slidably, and adjustable for position through the agency of spring means 42, by a sleeve 43 attached to the second horizontal member 23.

Figure 3:
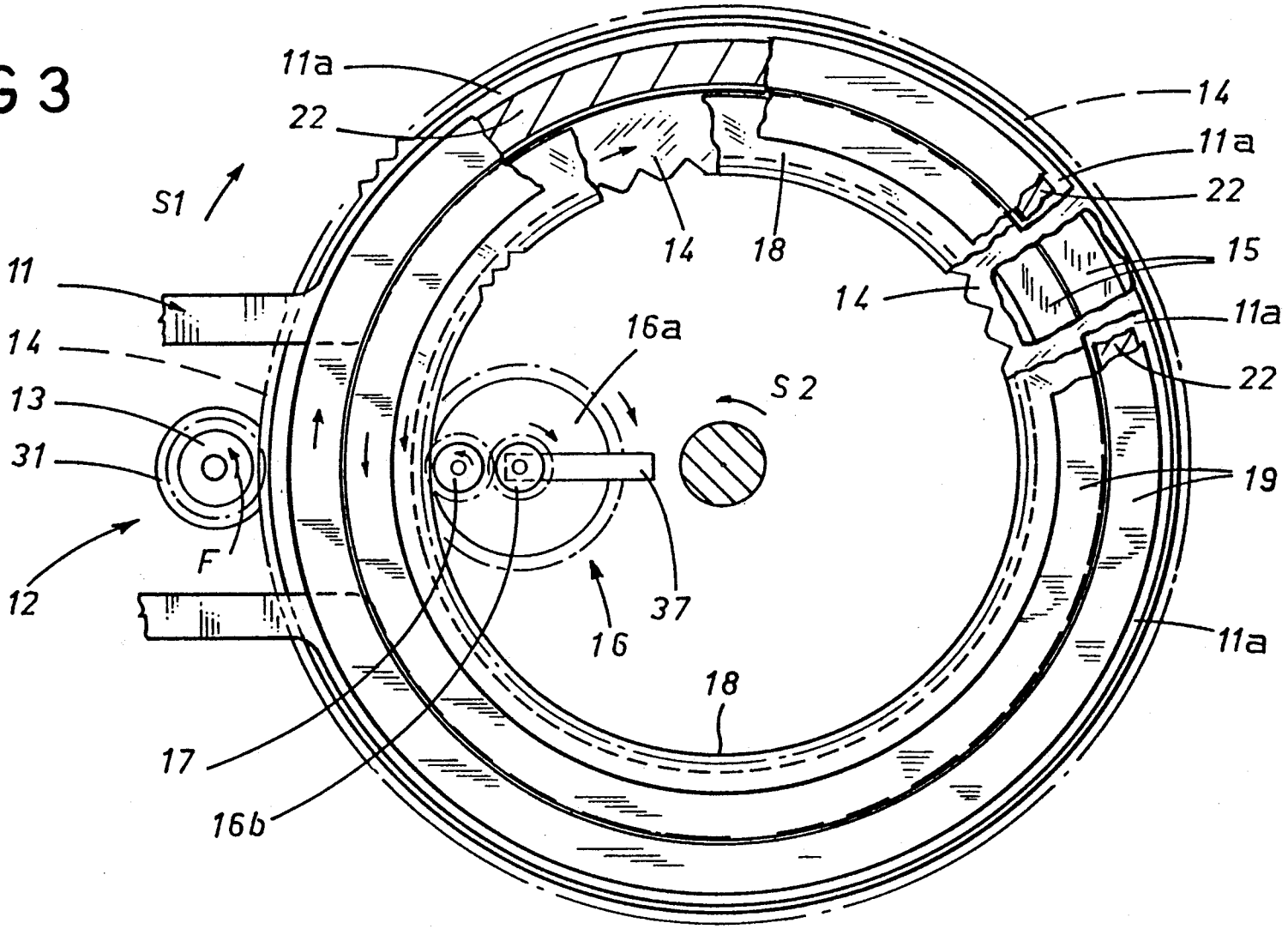
FIG. 3 is a top view of the apparatus, and more especially of the drive transmission of FIG. 2, in which certain parts are cut away better to reveal others.

With an apparatus thus embodied, the operation of wrapping palletized stacks of commodities 8 occurs in the following manner: a pallet 7 stacked with commodities 8 is set down on or conveyed onto the platform 6, whereupon the free end of the film 5 is drawn from the roll 4 and anchored by the gripping means 10, while the restraint mechanism 9 is caused to descend and engage the upward-facing side of the commodities 8; thereafter, the geared motor 31 is activated to rotate the first gear wheel 13 in the direction denoted F in FIGS. 2 and 3, the result of which is that the first ring gear 14 rotates in the first direction S1 on the relative bearing 15, and with it the horizontal member 11. The first ring gear 14 sets both the bottom wheel 16*a* and the top wheel 16*b* of the double idler 16 in rotation, and in the same direction S1. The top wheel 16*b* in its turn rotates the second idler 17 in the opposite direction F1 to that of its own rotation, with the result that the second ring gear 18 is also set in rotation, enabled by the bearing 19 to move in the direction S2 opposite to the direction S1 of the first ring gear 14, and with it, the platform 6. From this point, wrapping of the pallet 7 proceeds continuously as the horizontal member 11 and the platform 6 rotate in mutually opposite directions (clockwise and anticlockwise, or viceversa), and the roll 4 of material 5 ascends and descends on the vertical member 3 of the beam 2 (arrow F3) to ensure that the stacked commodities 8 are enveloped completely from top to bottom.

An apparatus thus embodied is able to wrap pallets swiftly and securely, employing a simple and safe structure of compact dimensions that requires the minimum of space in which to operate; and with the center of mass of the beam situated low in relation to the frame, furthermore, it becomes possible to dispense with the cumbersome and costly stabilizing structures necessitated by prior art embodiments of the type mentioned at the outset, and thus achieve a notable reduction in the cost of the apparatus as a whole.

What is claimed is:

1. An apparatus for wrapping palletized stacks of commodities in plastic film material, comprising:

a frame, affording a horizontal bed;

a horizontal platform, mounted on said frame, on which to stand a single pallet base stacked with commodities;

a beam substantially of 'L' profile exhibiting a horizontal member and a vertical member, supported by and anchored rotatably to the frame and set in motion by drive means, of which the vertical member carries a roll of plastic film material rotatable about its own vertical axis and invested with controlled axial movement by further drive means in such a way as to ascend and descend on the vertical member, and the horizontal member is positioned beneath the roll, extending between the horizontal bed and the platform, and anchored in rotation at a point low down in the apparatus, coinciding with the axis about which the beam is caused to rotate in a first direction;

gripping means, positioned adjacent to the roll, by which the film is secured to the commodities at its free end before the start of the wrapping operation and cut on completion of the operation;

a drive transmission means, interposed between the frame and the platform and associated both with the platform and with the horizontal member of the 'L' profile beam, said drive transmission means causing said beam to rotate in the first direction for generating the wrapping action, and said drive transmission means causing at least the part of the platform occupied by the pallet to rotate simultaneously in the opposite second direction;

a single motor for driving said drive transmission means;

wherein the drive transmission means comprises:

a first driving gear wheel associated with drive means mounted to the frame by which the horizontal member is caused to rotate, in mesh with an internally and externally toothed first ring gear rigidly associated with the top face of a first bearing located between the horizontal member and the frame and allowing the horizontal member to rotate in the first direction;

a double idle gear freely rotatable and mounted to the frame, of which a bottom gear wheel meshes with the internal teeth of the first ring gear and a top gear wheel meshes in a plane above the plane of rotation of the horizontal member with a second idle gear, also freely rotatable and mounted to the frame;

an internally toothed second ring gear associated rigidly with a second bearing, said second ring gear meshing with said second idle gear, said second ring gear being located between the platform and the horizontal member, on which the platform is able to rotate in the direction opposite to that of the horizontal member.

2. An apparatus as in claim 1, wherein the drive transmission means comprises first and second bearings which are associated each with a relative centrally positioned rotary contactor or coupling of which the action accompanies rotation of the horizontal member and of the platform respectively, and the upper second bearing is seated on a ring serving also to distance it from the horizontal member.

3. An apparatus as in claim 1, further comprising a restraint mechanism associated with the 'L' profile beam, occupying a position above the platform at the free top end of the vertical member and carried by a second horizontal member disposed transversely to the vertical member, the purpose of which is to stabilize the stacked commodities for the duration of the wrapping operation.

4. An apparatus as in claim 1, wherein the part of the horizontal member interposed between the platform and the frame is of annular embodiment.

5. An apparatus as in claim 1, wherein the platform consists in at least one section of a roller table with which the gripping means are associated on one side.

6. An apparatus for wrapping a palletized load with a sheet material, the apparatus comprising:

a platform which carries the palletized load;

a beam carrying a roll of wrapping plastic film, said beam being located at a predetermined distance from said platform; and, a means, operatively connected to said platform and to said beam, for creating a relative rotation between the palletized load and the roll of wrapping plastic film, said means comprising:

a motor, a first linkage for connecting said motor to said beam, a second linkage for connecting said motor to said platform, wherein said motor drives said first linkage so as to rotate said beam in a first direction and simultaneously drives said second linkage to rotate said platform in a second direction;

wherein said first linkage comprises:

a first gear ring secured to said beam;

a gear wheel secured to a shaft of said motor, said gear wheel being in eared connection with said first gear ring;

wherein said second linkage comprises:

a bracket having first and second ends, said first end being secured to a support surface;

a gear assembly secured to said second end of said bracket, said gear assembly being in geared connection with said first gear ring; and, a second gear ring secured to said platform, said second gear ring being in geared connection with said gear assembly.

7. The apparatus of claim 6 further comprising a gripping means for securing an end of said wrapping plastic film before the start of the wrapping operation.

8. The apparatus of claim 6 further comprising a restraint means located above the palletized load for stabilizing the palletized load.

9. The apparatus of claim 8 further comprising a connecting arm for connecting said restraint means to said beam.

10. An apparatus for wrapping a palletized load with a sheet material, the apparatus comprising:

a platform which carries the palletized load;

a beam carrying a roll of wrapping plastic film, said beam being located at a predetermined distance from said platform, said beam comprising:

a vertical arm, and a first horizontal arm, said roll of plastic film being suspended from said vertical arm and said first horizontal arm extending to said platform; and, a mechanism, operatively connected to said platform and to said beam, for rotating said platform and hence the palletized load in a first direction and for rotating said beam and the roll of wrapping plastic film in a second and opposite direction, said mechanism comprising:

a motor, a first linkage for connecting said motor to said beam, a second linkage for connecting said motor to said platform, wherein said motor drives said first linkage so as to rotate said beam in a first direction and simultaneously drives said second linkage to rotate said platform in a second direction;

wherein said first linkage comprises:

a first gear ring secured to said beam;

a gear wheel secured to a shaft of said motor, said gear wheel being in geared connection with said first gear ring;

wherein said second linkage comprises:

a bracket having first and second ends, said first end being secured to a support surface;

a gear assembly secured to said second end of said bracket, said gear assembly being in geared connection with said first gear ring; and, a second gear ring secured to said platform, said second gear ring being in geared connection with said gear assembly.

11. The apparatus of claim 10 further comprising a carriage bracket for mounting said roll of wrapping film on said vertical arm of said beam and further comprising a means for raising and lowering said carriage bracket on said vertical arm.

12. The apparatus of claim 10 further comprising a gripping means for securing an end of said wrapping plastic film before the start of the wrapping operation.

13. The apparatus of claim 10 further comprising a restraint means located above the palletized load for stabilizing the palletized load.

14. The apparatus of claim 13 further comprising a second horizontal arm having a first end to which said restraint means is connected and having a second end connected to said vertical arm of said beam.

* * * * *